US009151096B2

(12) United States Patent
Hunt et al.

(10) Patent No.: US 9,151,096 B2
(45) Date of Patent: Oct. 6, 2015

(54) ACCESS CONTROL DEVICE FOR A DOOR

(75) Inventors: Robert C. Hunt, Reno, NV (US); Jonathan King, Washoe Valley, NV (US); Larry Gene Corwin, Jr., Fernley, NV (US); Paul Justus Rodgers, Reno, NV (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 760 days.

(21) Appl. No.: 12/883,618

(22) Filed: Sep. 16, 2010

(65) Prior Publication Data

US 2011/0067308 A1 Mar. 24, 2011

Related U.S. Application Data

(60) Provisional application No. 61/244,047, filed on Sep. 20, 2009.

(51) Int. Cl.

| | |
|---|---|
| ***E05B 65/10*** | (2006.01) |
| ***E05C 19/16*** | (2006.01) |
| *E05B 3/00* | (2006.01) |
| *E05B 1/00* | (2006.01) |
| *E05B 17/10* | (2006.01) |
| *E05B 17/22* | (2006.01) |
| *E05B 63/04* | (2006.01) |

(52) U.S. Cl.

CPC ..... *E05C 19/166* (2013.01); *E05B 1/0069* (2013.01); *E05B 17/10* (2013.01); *E05B 17/22* (2013.01); *E05B 63/04* (2013.01); *E05B 65/1053* (2013.01)

(58) Field of Classification Search

USPC ..... 292/251.5, 92–94, DIG. 25, DIG. 26, 292/DIG. 56, DIG. 65, 336.3; 70/92, 70/262–266, 276, 277, 465; 340/5.72; 49/31; 200/61.62

See application file for complete search history.

(56) References Cited

U.S. PATENT DOCUMENTS

| | | | | |
|---|---|---|---|---|
| 3,495,353 | A * | 2/1970 | Forsberg | 49/25 |
| 3,496,381 | A * | 2/1970 | Wisnia | 307/125 |
| 3,549,903 | A * | 12/1970 | Lowdenslager | 327/172 |
| 4,006,471 | A * | 2/1977 | Pappas | 340/542 |
| 4,287,513 | A * | 9/1981 | Lam et al. | 340/562 |

(Continued)

FOREIGN PATENT DOCUMENTS

EP 818751 A1 * 1/1998

OTHER PUBLICATIONS

STIC Search Report, conducted Aug. 26, 2013.*

*Primary Examiner* — Alyson M Merlino

(74) *Attorney, Agent, or Firm* — Woods Oviatt Gilman LLP; Ronald J. Kisicki, Esq.

(57) ABSTRACT

A door release system including a capacitive circuit that includes a touch bar, a microprocessor within the touch bar programmed with noise-discrimination software to sense touching of the bar, and at least one micro-switch within the bar to function as a back-up that picks up movement of the bar to release the latch should the capacitive circuit fail. Optionally, a sign illuminated by LEDs and an antimicrobial coating/treatment may be applied to the bar. The system is intended for use on magnetically locked doors. The addition of the micro-switches that are actuatable by continued movement on the touch bar after the bar is initially touched provides a redundant access function initiated by other than the capacitive effect of human touch, which is expected to simplify use and ease accessibility for personnel with prosthetics or who may otherwise have their hands occupied.

14 Claims, 23 Drawing Sheets

(56) References Cited

U.S. PATENT DOCUMENTS

| | | | | | |
|---|---|---|---|---|---|
| 4,682,801 | A | * | 7/1987 | Cook et al. | 292/251.5 |
| 4,733,923 | A | * | 3/1988 | Dahnert | 312/201 |
| 4,743,078 | A | * | 5/1988 | Dahnert | 312/201 |
| 4,759,592 | A | * | 7/1988 | Dahnert | 312/201 |
| 4,831,279 | A | * | 5/1989 | Ingraham | 307/116 |
| 4,871,204 | A | | 10/1989 | Cook et al. | |
| 4,893,852 | A | * | 1/1990 | Harris et al. | 292/251.5 |
| 4,930,037 | A | * | 5/1990 | Woo | 361/58 |
| 5,065,136 | A | * | 11/1991 | Frolov et al. | 340/545.2 |
| 5,184,855 | A | * | 2/1993 | Waltz et al. | 292/251.5 |
| 5,429,399 | A | * | 7/1995 | Geringer et al. | 292/92 |
| 5,479,151 | A | * | 12/1995 | Lavelle et al. | 340/542 |
| 5,496,079 | A | * | 3/1996 | Frolov | 292/251.5 |
| 5,517,176 | A | * | 5/1996 | Lavelle et al. | 340/542 |
| 5,841,619 | A | * | 11/1998 | Shigehara et al. | 361/111 |
| 5,844,262 | A | * | 12/1998 | Ooishi | 257/207 |
| 5,969,440 | A | | 10/1999 | Young et al. | |
| 6,429,782 | B2 | * | 8/2002 | Pavatich et al. | 340/686.6 |
| 6,486,793 | B1 | * | 11/2002 | Buccola | 340/5.2 |
| 6,609,400 | B2 | * | 8/2003 | Luker | 70/92 |
| 6,715,225 | B1 | * | 4/2004 | Frolov et al. | 40/570 |
| 6,996,732 | B2 | * | 2/2006 | Kotlow et al. | 713/324 |
| 7,051,560 | B2 | * | 5/2006 | Sanchirico et al. | 70/92 |
| 7,076,229 | B2 | * | 7/2006 | Wang | 455/296 |
| 7,108,301 | B2 | * | 9/2006 | Louvel | 292/336.3 |
| 7,287,785 | B2 | * | 10/2007 | Schupp et al. | 292/216 |
| 7,906,875 | B2 | * | 3/2011 | Caldwell et al. | 307/139 |
| 2002/0179725 | A1 | * | 12/2002 | Shearer | 236/78 R |
| 2004/0254437 | A1 | * | 12/2004 | Hauck et al. | 600/374 |
| 2006/0006678 | A1 | * | 1/2006 | Herron, Jr. | 292/336.3 |

* cited by examiner

| | | | |
|---|---|---|---|
| FIG. 4A. | FIG. 4B. | FIG. 4C. | FIG. 4D. |
| FIG. 4E. | FIG. 4F. | FIG. 4G. | FIG. 4H. |
| FIG. 4I. | FIG. 4J. | FIG. 4K. | FIG. 4L. |
| FIG. 4M. | FIG. 4N. | FIG. 4O. | FIG. 4P. |

FIG. 4.

ACCESS CONTROL DEVICE FOR A DOOR

REFERENCE TO PRIOR APPLICATIONS

This application claims the benefit of U.S. Provisional Application 61/244,047, filed Sep. 20, 2009.

TECHNICAL FIELD

The present invention relates to releasable door access control devices; more particularly, to such devices having redundant release sensing mechanisms; and most particularly, to a device having a release bar that includes a microprocessor-controlled capacitive circuit to sense touching of the bar or proximity of an object to the bar and one or more micro-switches as back-up that pick up any slight movement of the bar so as to release the door should the capacitive circuit release feature be unresponsive.

BACKGROUND OF THE INVENTION

A requirement of magnetically-locked exit doors is that the magnetic lock be deactivatable from within a building upon demand by a user desiring egress. A typical exit door is provided with a horizontal electromagnetic lock-deactivating bar mounted across the inner surface of the door and responsive in any of a wide variety of ways to pressure by a user. In the art, it is considered to be good design to provide two or more redundant deactivating systems to ensure that a door may be opened even if one of the systems malfunctions.

For example, U.S. Pat. No. 4,871,204 discloses a release system comprising a capacitive circuit, including a relay, that senses any touching of a fixed horizontal bar in a first user action, and a separate back-up micro-switch activatable circuit. The capacitive circuit relay, when engaged in response to the human touch sensor, includes means for opening the locking circuit for the electromagnetic lock. In the event of malfunction of the capacitance sensor system, egress can still be accomplished, in a second and separate user action. This is accomplished by pressing the push button switch, mounted on or near the bar, which activates the capacitive circuit relay.

A shortcoming of the disclosed system is that the capacitive sensor output signal can be corrupted by electronic noise, causing the door to become unlocked when not intended and potentially allowing ingress from the outside. A further shortcoming is that a second distinct user action is required to open the door if the capacitive sensor system fails. A user may not know of the push button switch, or a user may not remember the position of the push button switch or how the switch may be activated, especially in this system since the switch is concealed behind the push bar.

For another example, U.S. Pat. No. 5,969,440 discloses a release system comprising two electromechanical force transducer assemblies mounted within a moveable bar and responsive to translation of the bar. When a given amount of pressure is detected by either or both of the electromechanical force transducer assemblies, the door will be unlocked and can be subsequently opened. A back up switch is also located on the bar and will operate in a fail-safe manner (without power) to unlock the door in the event of a failure of one or both of the transducer assemblies upon detection of a greater amount of force being exerted upon the bar.

A shortcoming of the disclosed system is that activation of either or both of the transducers requires substantial force, for example, between 5 and 15 pounds of pressure, and operation of the back-up micro-switch requires not less than 15 pounds of pressure. The large force required to operate the back-up switch is needed to ensure that the pressure transducers come into play before the back-up switch is used. Forces in this high range may be beyond the capabilities of a user in a given situation. Further, the disclosed electromechanical force sensors use force sensing resistors whose sensitivity and output may change with aging of the sensors or of the associated actuating padding material.

In yet another example, U.S. Pat. No. 6,429,782 B2 discloses a door release system comprising a conductor forming part of a capacitor with variable capacitance dependent upon the proximity of a person, and a detector for sensing variation in the capacitance and for generating an output signal indicating proximity of the person relative to the conductor as the person's hand touches the release. The switch device further includes a mechanical switch arranged for actuation by a person gripping or pulling the door handle to additionally or alternatively indicate proximity of the person. The system includes an oscillator coupled to the conductor and a phase comparator. The variation in capacitance results in an associated change of frequency in the oscillator to produce a phase-modulated signal which is applied to the phase comparator to generate a signal representative of the change in frequency.

What is needed in the art is a door latch release system that includes a capacitive circuit including at least one capacitive sensor, a micro-processor programmed with noise-discrimination software to sense touching of the bar and a micro-switch, or switches, as back-up that picks up movement of the bar to release the door should the capacitive circuit be unresponsive.

It is a principal object of the present invention to increase the reliability of a door is release system by incorporating a back-up system that can redundantly release the door upon a natural and continued motion of the person opening the door.

It is a further object of the present invention to increase the reliability of a door release system by discriminating against spurious noise signals that can cause a capacitive switching system to open inadvertently or to be opened maliciously while also providing a back-up door release switch which is less sensitive to pounding on the exterior side of the door.

SUMMARY OF THE INVENTION

Briefly described, a door release system in accordance with the present invention includes a release bar, a capacitive circuit operatively connected to the bar, a micro-processor within the bar programmed with signal noise-discrimination software to sense actual touching of the bar and prevent spurious signals from causing non-intentional release of the door, and at least one micro-switch within the bar to function as a back-up that picks up movement of the bar to release the door should the capacitive circuit be unresponsive, for example, upon a failure of the capacitive circuit or if insufficient capacitance is added to the touch bar. The bar includes a primary mechanical switching actuation with reduced sensitivity to door vibrations in addition to an improved version of the capacitance-only touch sense function disclosed in U.S. Pat. No. 4,871,204, which is incorporated herein by reference. Optionally, an illuminated sign within the bar provides continuous identification of the door as an exit. Optionally an anti-microbial coating/treatment may be applied to the bar and end caps.

The system is intended for use on magnetically locked, non-fire rated doors. The addition of the mechanical switch actuation to the bar provides a new primary access function initiated by other than the capacitive human touch, which is expected to simplify use and ease accessibility for personnel with prosthetics or who may otherwise have their hands occupied (e.g. carrying boxes, manipulating carts, wheelchairs, etc.). In addition to capacitance-initiated touch sense function, mechanical movement of the bar is provided which is responsive to a lateral force as applied by any object (i.e. human hand pressure, hip, prosthesis, wheelchair, box, briefcase, etc.) to initiate activation of internal position detecting switches. The bar provides a release signal for as long as it senses capacitance from a human touch or by maintained mechanical switch actuation. The bar is fail safe (no power required) and a non-latching mechanical device.

The system allows re-securing of the door when the bar is released to allow the spring mechanism to return the bar to its original (at rest) position, thus disengaging the position detecting switches and when the human hand is totally disengaged from the bar.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
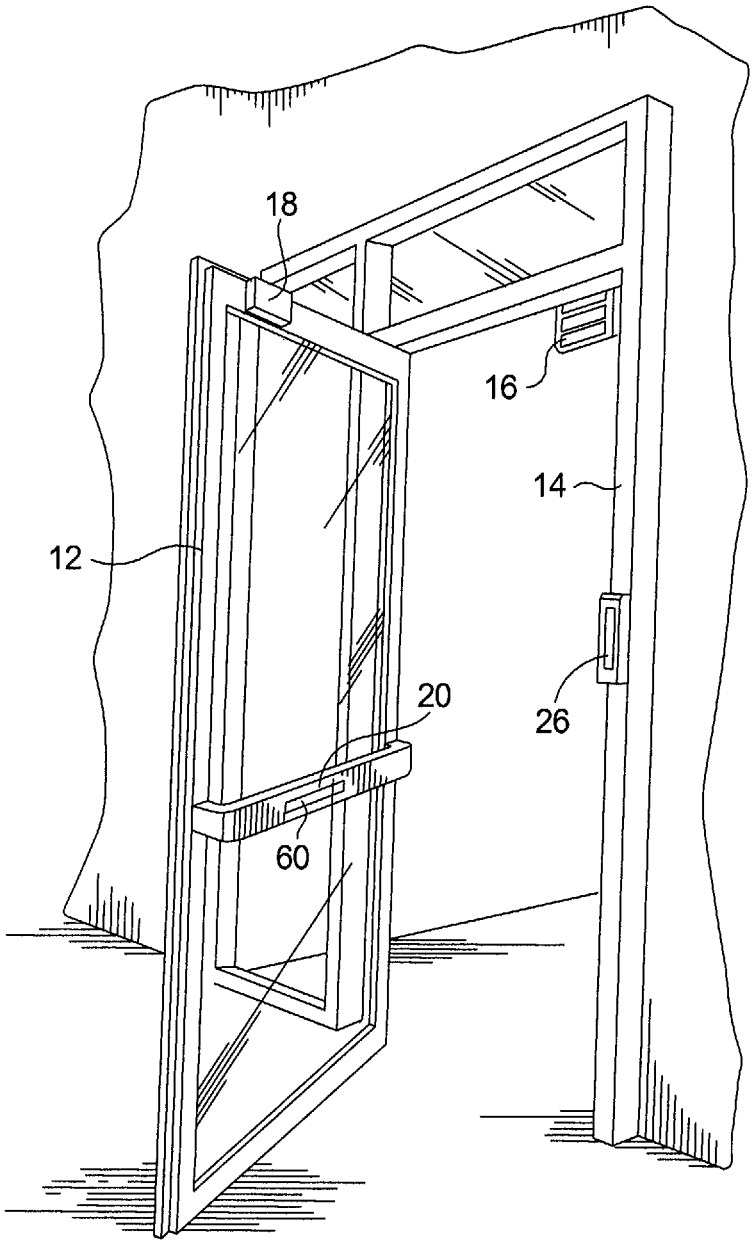
FIG. 1 is an isometric view of a door release system in accordance with the present invention mounted on a door in a frame and an electromagnetic lock including an electromagnet on the door frame and an opposing striker plate or armature mounted on the door.
Figure 2A:
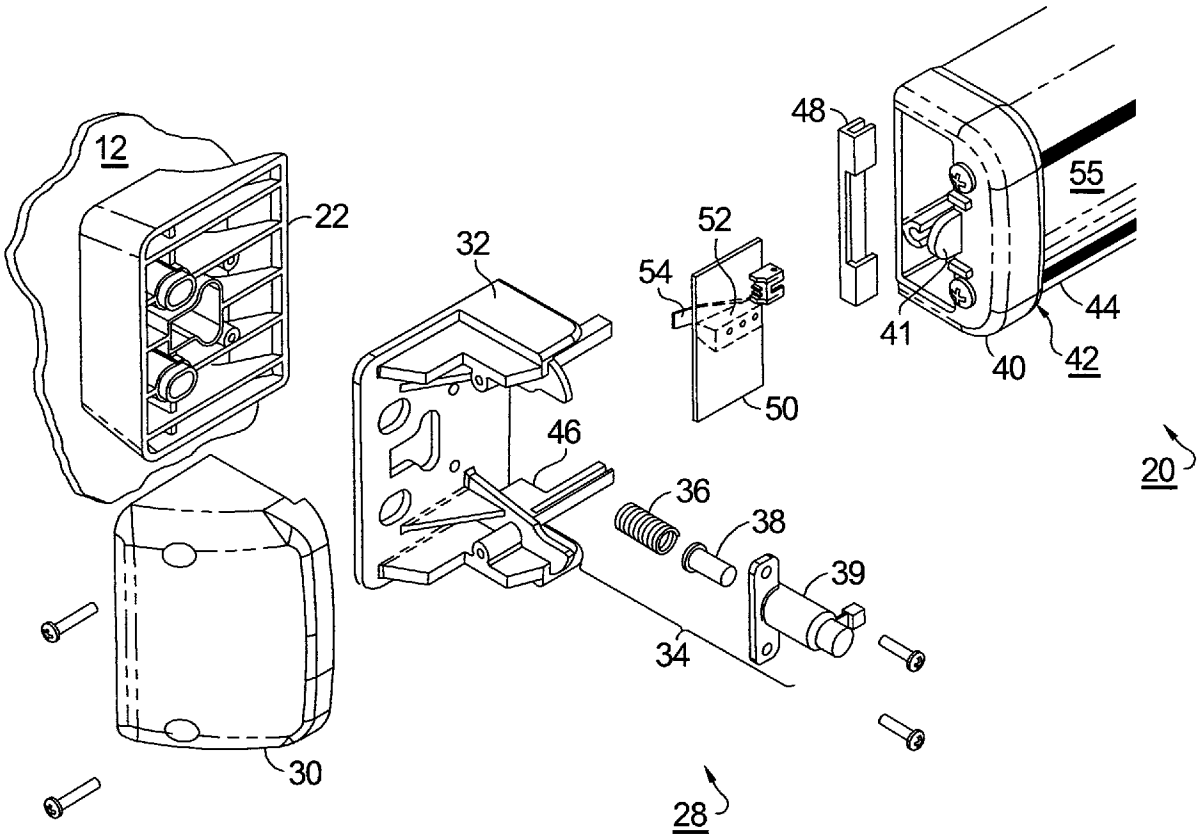
FIG. 2A is an exploded isometric view an end portion of the door release system shown in FIG. 1, in accordance with the invention
Figure 2B:
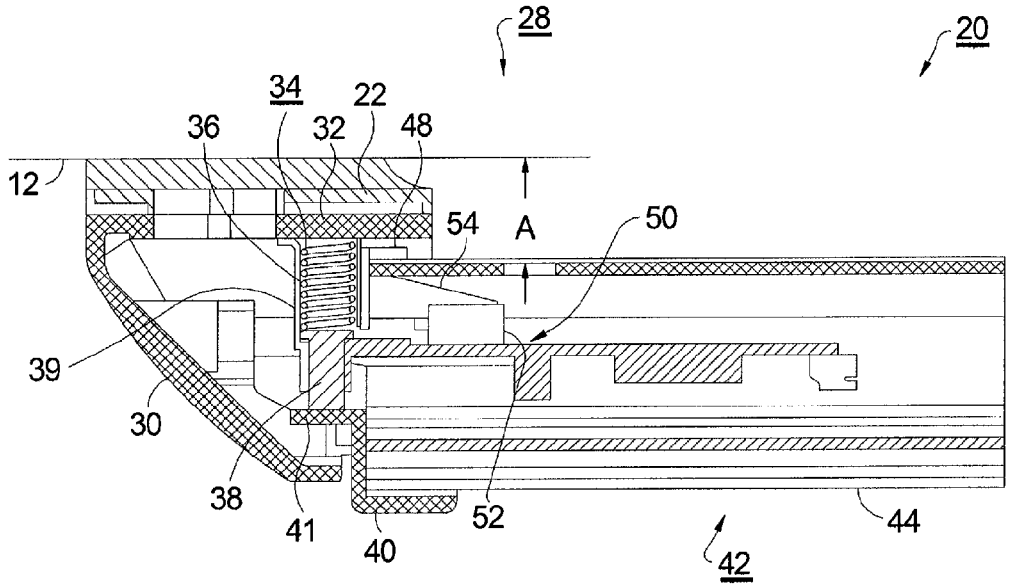
FIG. 2B is a cross-sectional view of an end portion of the door release system shown in FIG. 1, showing the system at rest in accordance with the invention.
Figure 3:
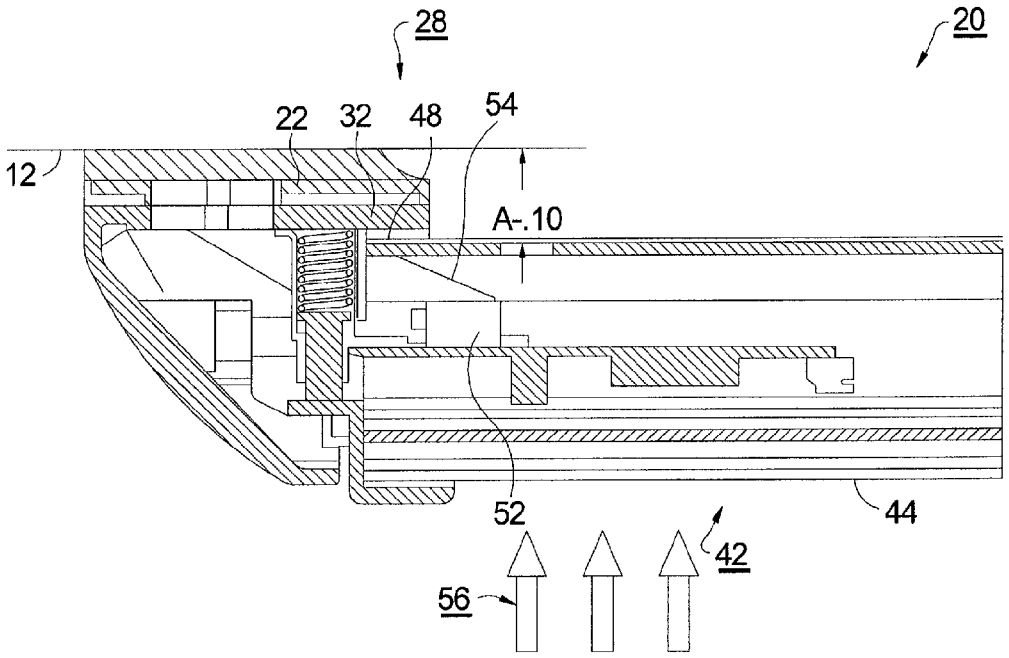
FIG. 3 is a cross-sectional view like that shown in FIG. 2B, showing the door release system in an activated position.

Referring to the drawings, FIG. 1 shows a door 12 and a door frame 14. Secured to the door frame is an electromagnet 16 which, together with the striker plate or armature 18 on the door forms an electromagnetic lock. On the inside of the door and mounted thereon is a door release system 20 in accordance with the present invention, mounted to door 12 by insulating blocks 22 used to electrically isolate the bar assembly from the door (FIGS. 2A, 2B and 3). In order to gain access to the interior of the secured area, inside door 12, a coded input panel 26 (FIG. 1) may be provided.

However, when egress from the secured area on the interior of the door 12 is desired, a person merely touches or pushes against system 20 and the result is to release the electromagnetic lock 16, 18, so that the door 12 may be pushed open.

The precise method of de-energization of the electromagnetic lock 16, 18, will be discussed in greater detail below.

Referring to FIGS. 2A, 2B and 3, an end 28 of system 20 is shown, mounted on insulating block 22 disposed on the inner surface of door 12. The opposite end (not shown) of system 20 is substantially identical, permitting system 20 to be used without modification on either right-hinged (as shown in FIG. 1) or left-hinged doors. Touch bar assembly 42 includes touch bar 44 and touch bar holder 40. Actuator end cap 30 is attached to mounting bracket 32. A return spring subassembly 34 having a spring 36 and a plunger 38 contained within a housing 39 is secured to mounting bracket 32 preferably with screws. Plunger 38 is positioned against a tab 41 on bar holder 40 which maintains location of touch bar assembly 42 against locating features 46 in mounting bracket 32. Touch bar assembly 42 includes a sound deadening pad 48 attached to eliminate objectionable noise during movement of the bar assembly 42 in the mount bracket 32. Touch bar assembly 42 is movable within end mounting bracket 32 in a plane orthogonal to door 12, as shown in FIG. 3. A control PC board 50 and micro-switch 52 are disposed on rail features formed within mounting bracket 32. Micro-switch 52 includes a leaf spring 54 abutting wall 55 of touch bar 44. Touch bar 44 is part of a capacitive circuit as described below. At rest, bar 44 may be at a distance (A) from the surface of door 12, for example, about 1.25 inches, as shown in FIG. 2B. Actuator end cap 30 is attached to mount bracket 32 preferably with screws to protect return spring subassembly 34, PC board 50, mounting hardware and conductors from damage by carts, gurneys, etc. or from vandalism.

Note that a second pad 48 and micro-switch 52 (neither shown) are present at the opposite end of release system 20, the second micro-switch 52 being connected effectively in series with the shown micro-switch 52. Thus activation of either micro-switch 52 by itself serves to de-energize the electromagnetic lock.

Optionally, an illuminated sign 60 (FIG. 1), reading for example "PUSH TO EXIT", or other such messaging, may be formed in touch bar 44, preferably comprising a plurality of LEDs and a multi-strand fiber-optic cable disposed behind a clear faceplate.

Also optionally, the user contact surfaces of touch bar assembly 42 may be coated with an anti-microbial coating (not shown) to prevent the spread of bacteria, for example, a powder coat containing silver ion as is known in the prior art.

In operation, as shown in FIG. 3, when touch bar assembly 42 is touched by a user, the capacitive circuit is energized to cause electromagnetic lock 16,18 (FIG. 1) to be de-energized, permitting door 12 to be opened. However, if the capacitive circuit malfunctions, or if there is insufficient capacitance added by the touching, a continuing force 56 applied to touch bar assembly 42 in a continuous direction causes progressive translation of the touch bar toward the surface of door 12. As touch bar 44 continues to move toward door 12, leaf spring 54 moves away from the body of micro-switch 52, thereby opening an electrical contact therein, which serves to open the electromagnetic lock circuit and deactivate the lock. After a limited travel of assembly 42, for example, about 0.10 inch (opposed by return spring subassembly 34 and requiring a force of preferably only about 5 pounds), door 12 is released and pad 48 and touch bar assembly 42 are stopped by mounting bracket 32.

Thus, in a single motion, a user can de-energize the lock and open the door via either the capacitive circuit or the micro-switch, unlike the prior art system disclosed in the incorporated reference wherein the capacitive circuit is activated in a first user motion, and a second user motion is required to find and flip or push the back-up switch.

Figure 4A:
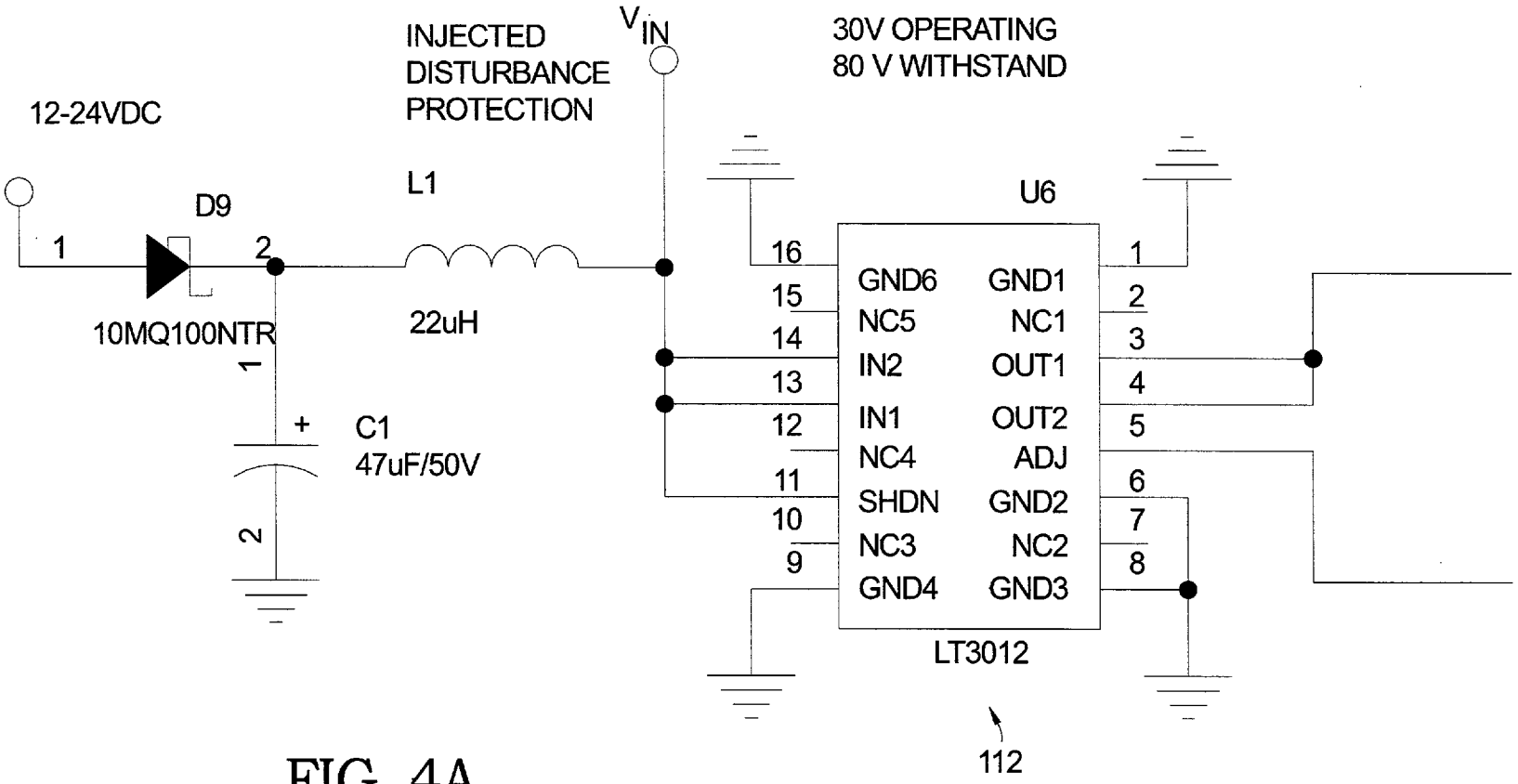
FIG. 4A-4P are connecting segments of a schematic diagram of the electrical control circuit in accordance with the invention.
Figure 4B:
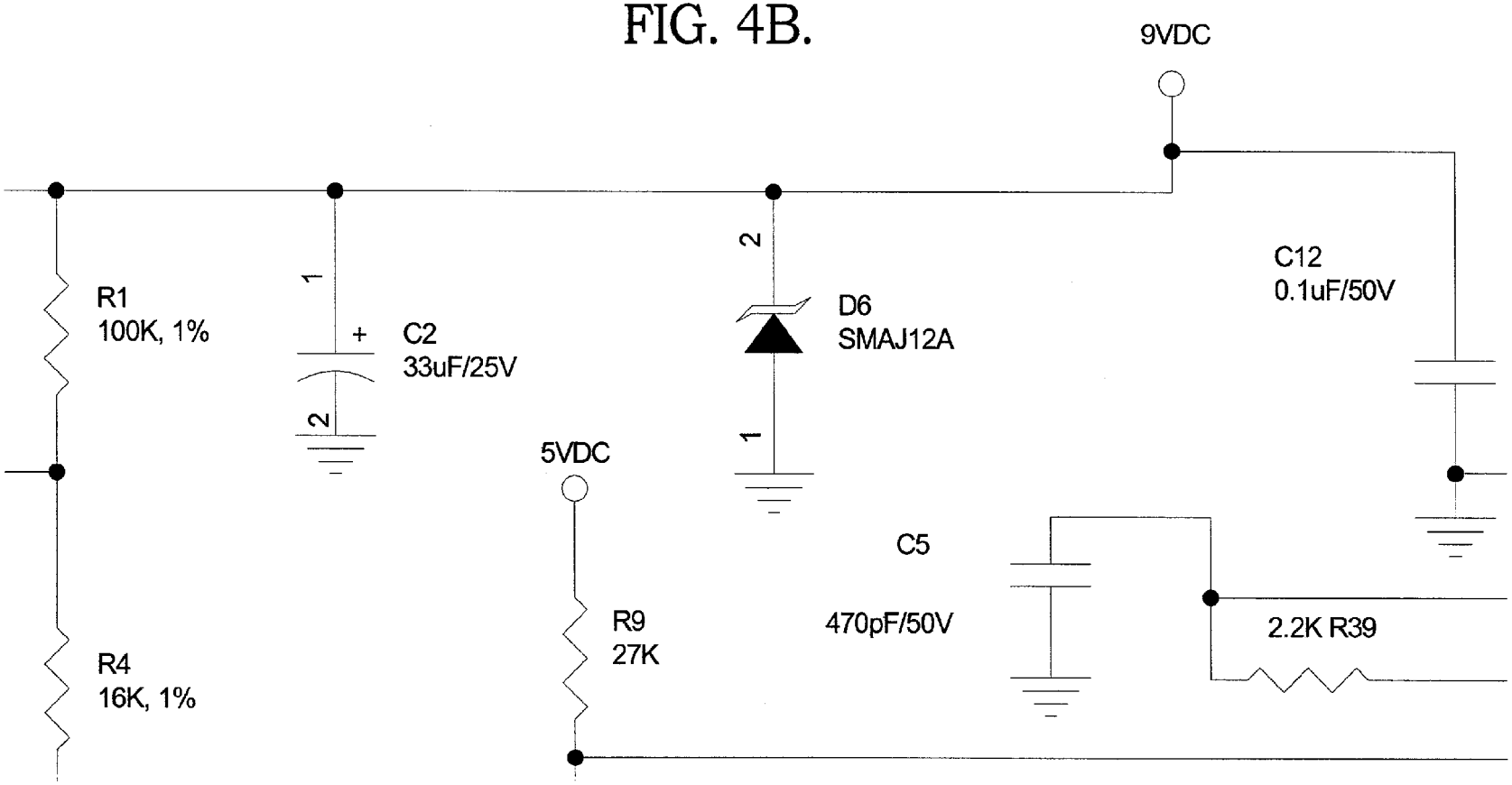
FIG. 4 shows the orientation of each segment shown in FIGS. 4A-4P to form the entire electrical control circuit diagram.
Figure 4C:
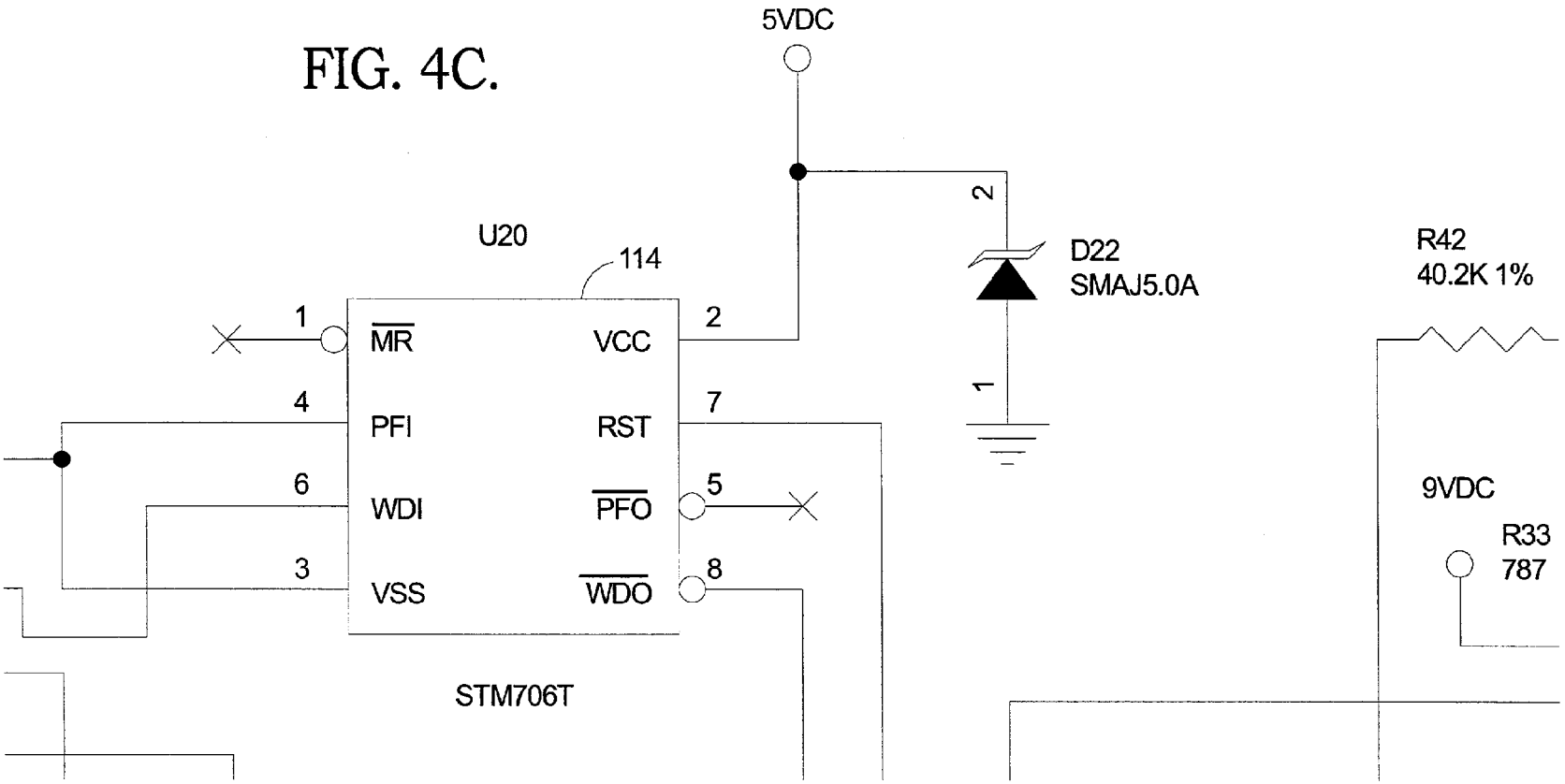
Figure 4D:
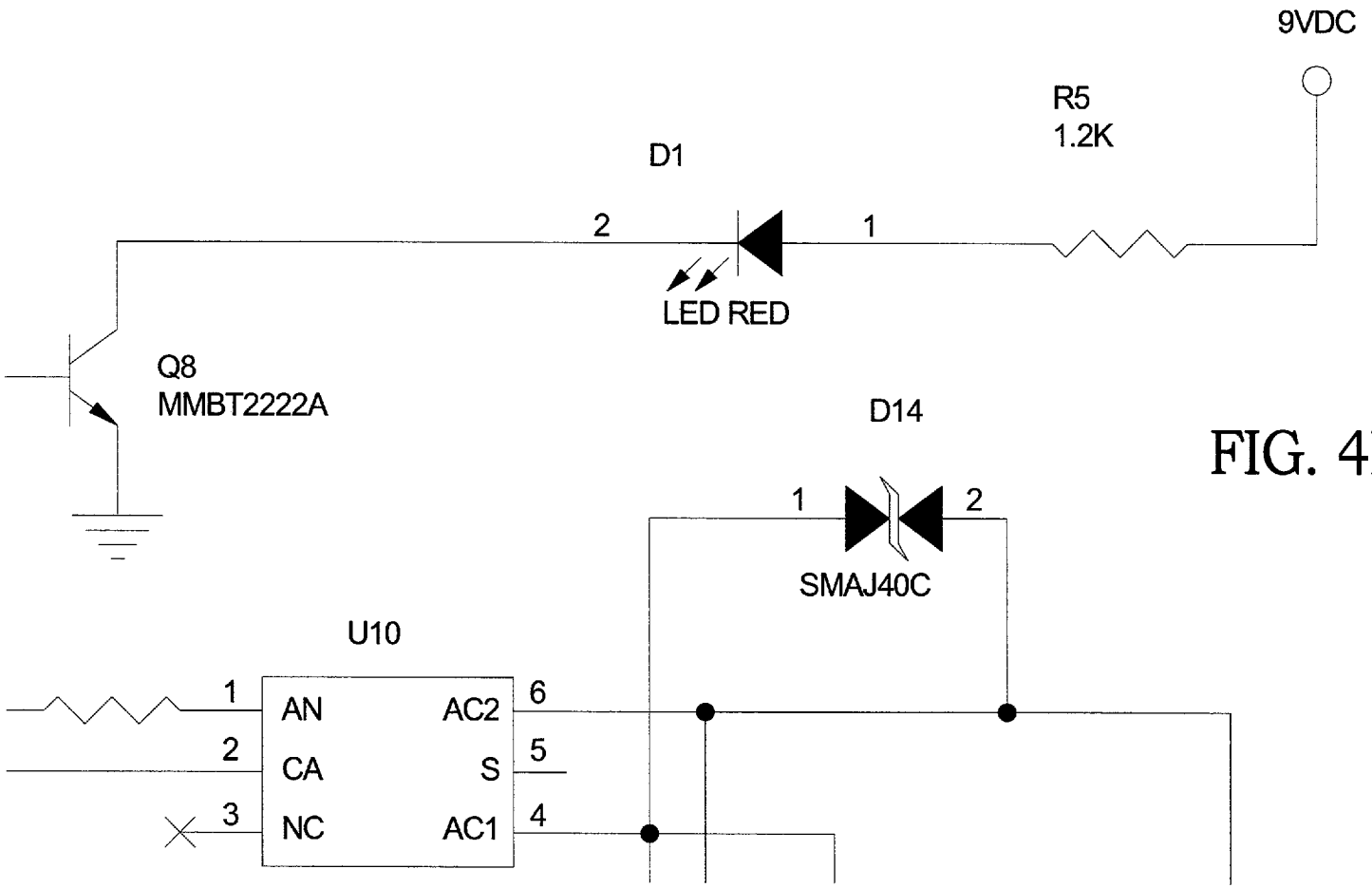
Figure 4E:
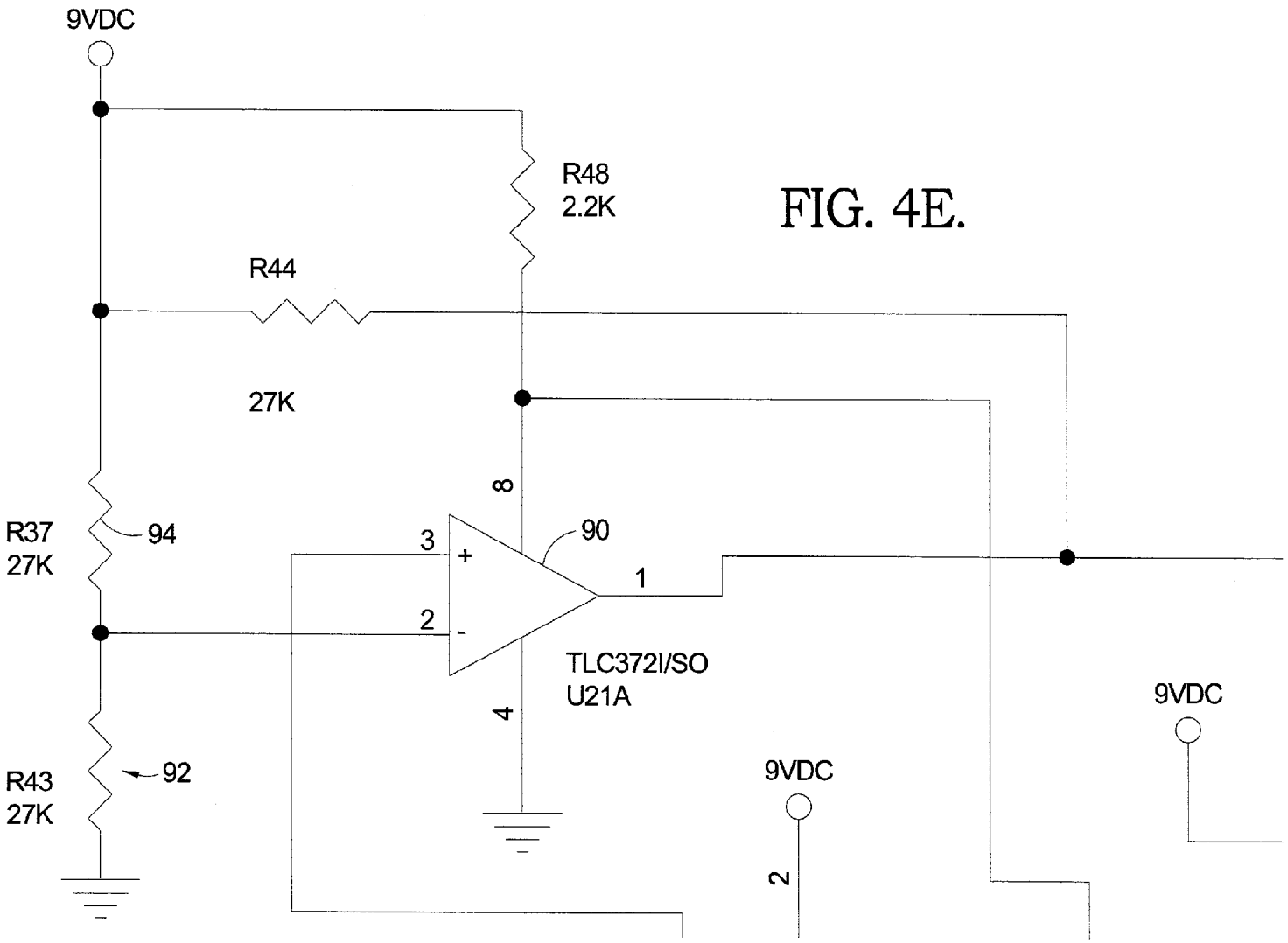
Figure 4F:
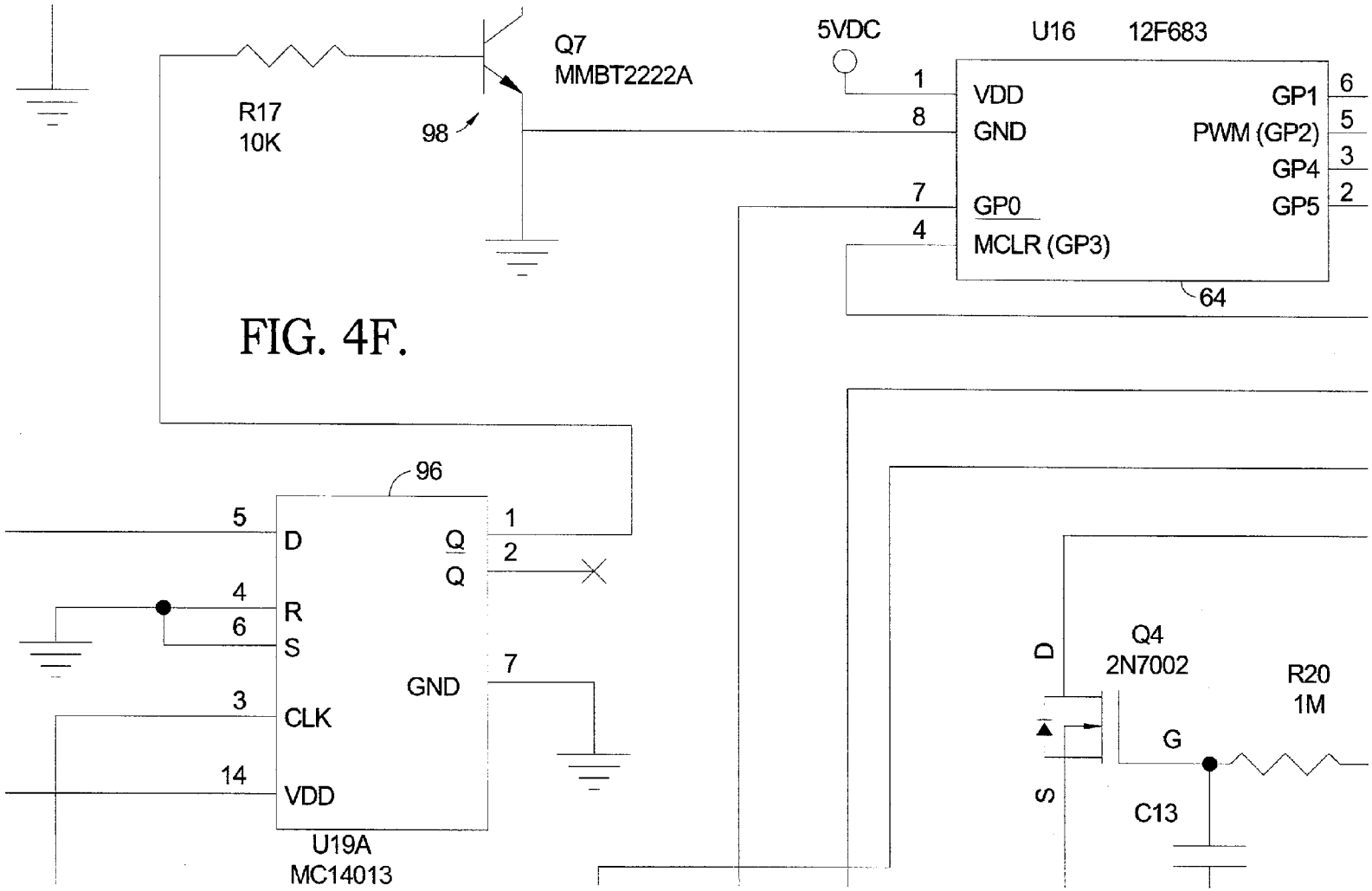
Figure 4G:
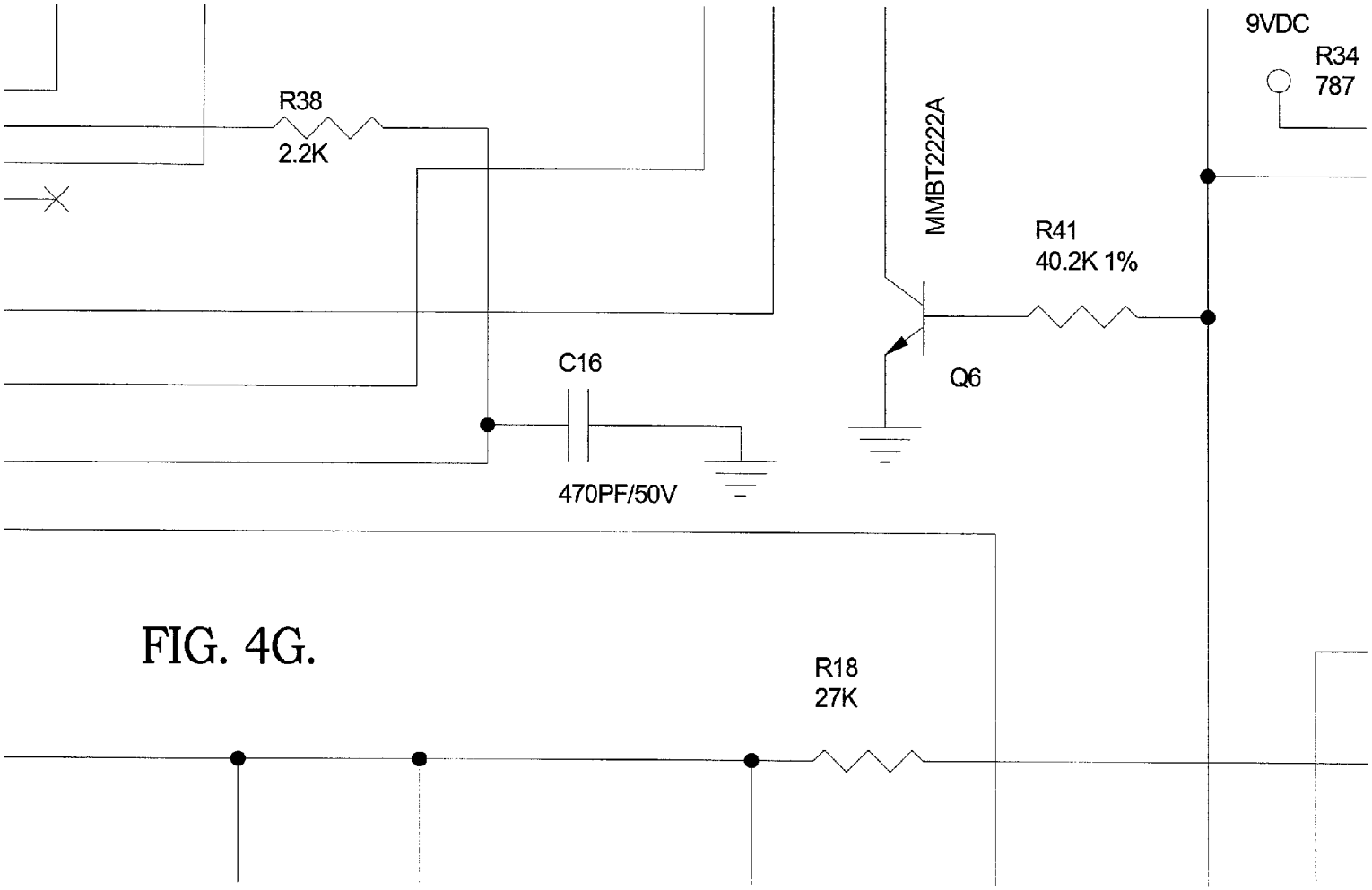
Figure 4H:
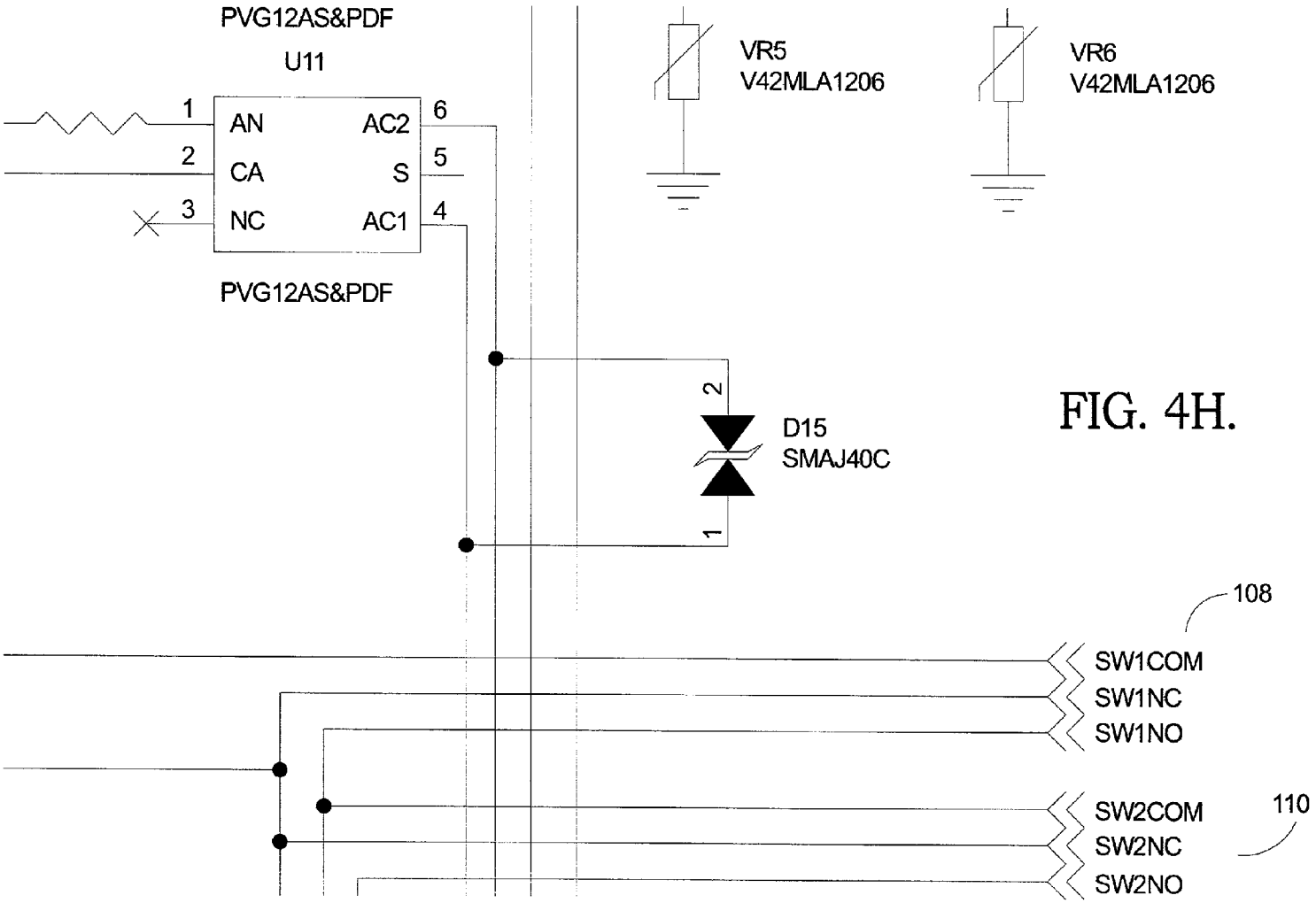
Figure 4I:
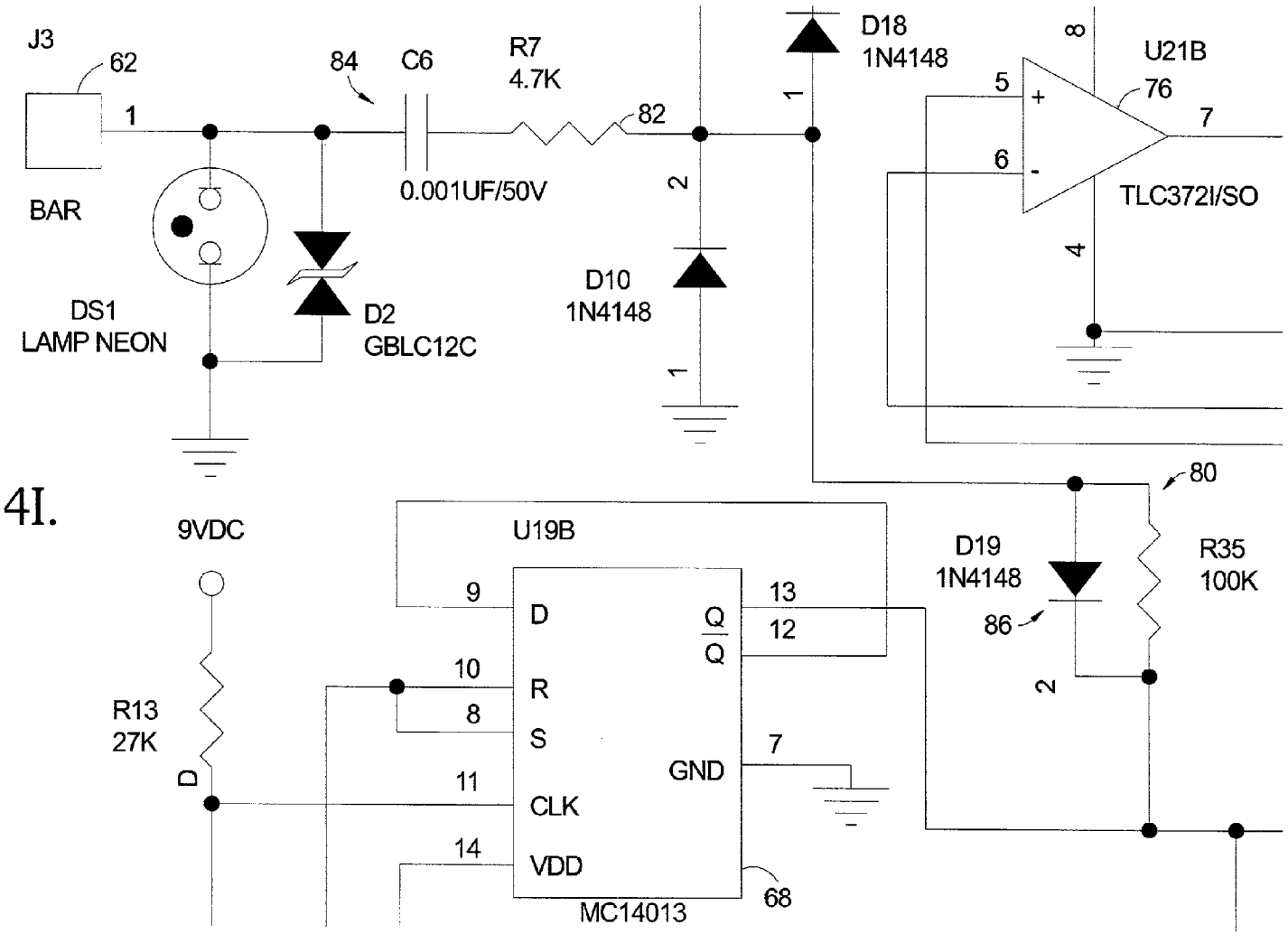
Figure 4J:
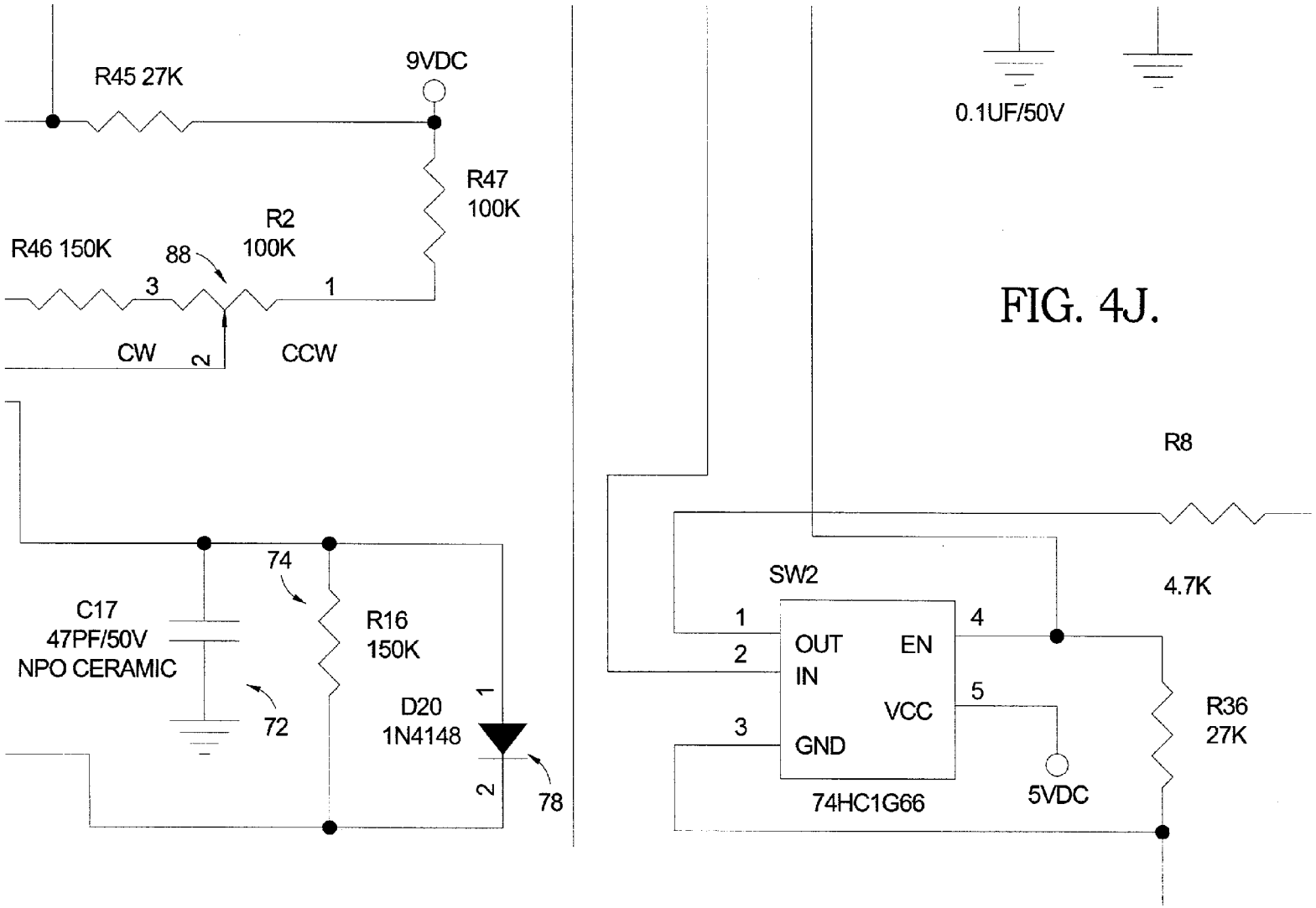
Figure 4K:
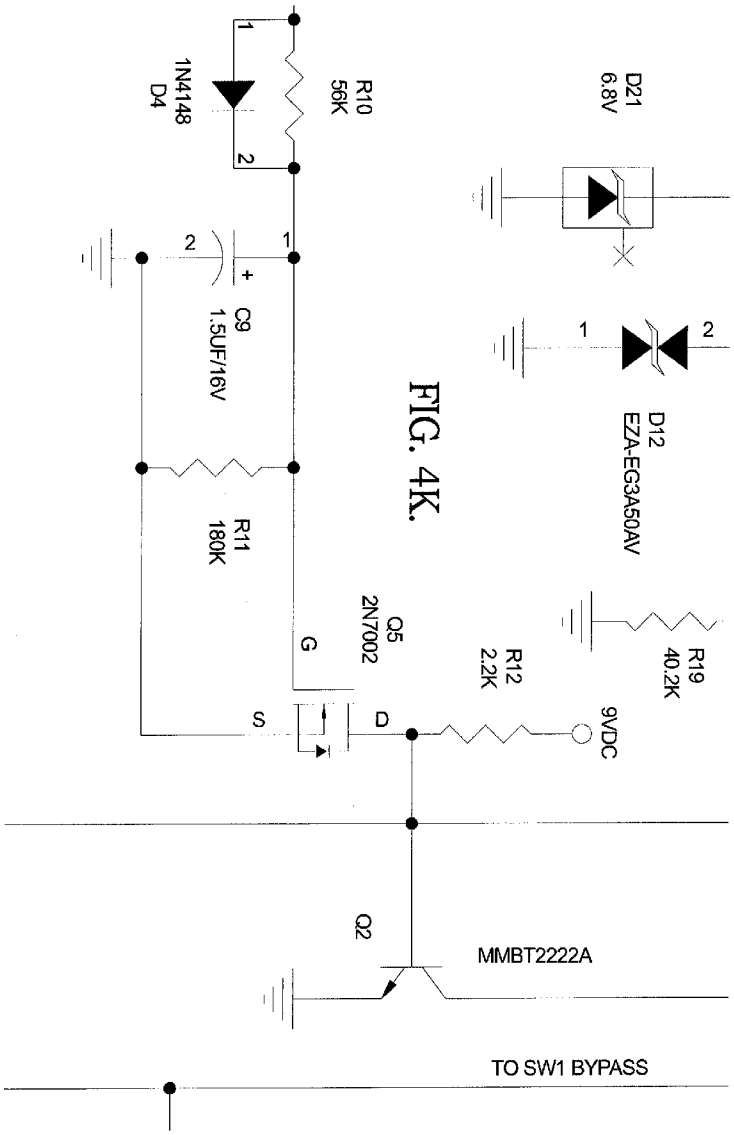
Figure 4L:
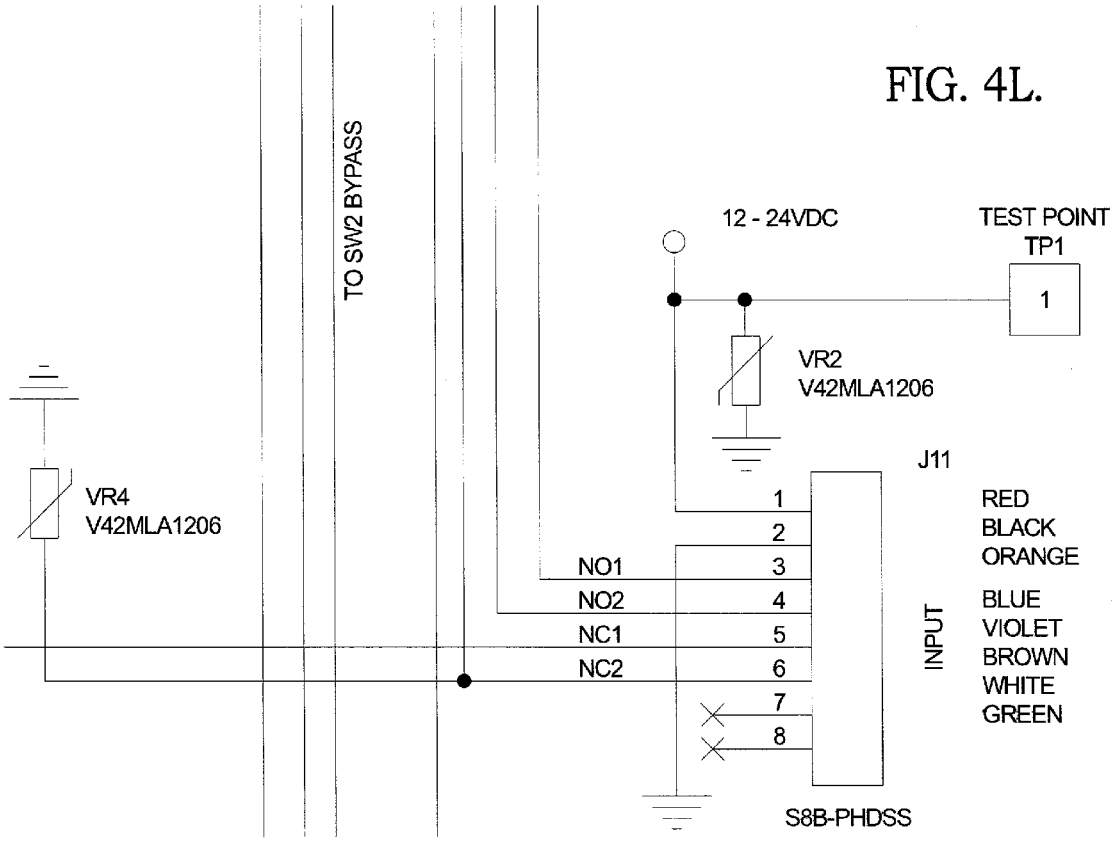
Figure 4M:
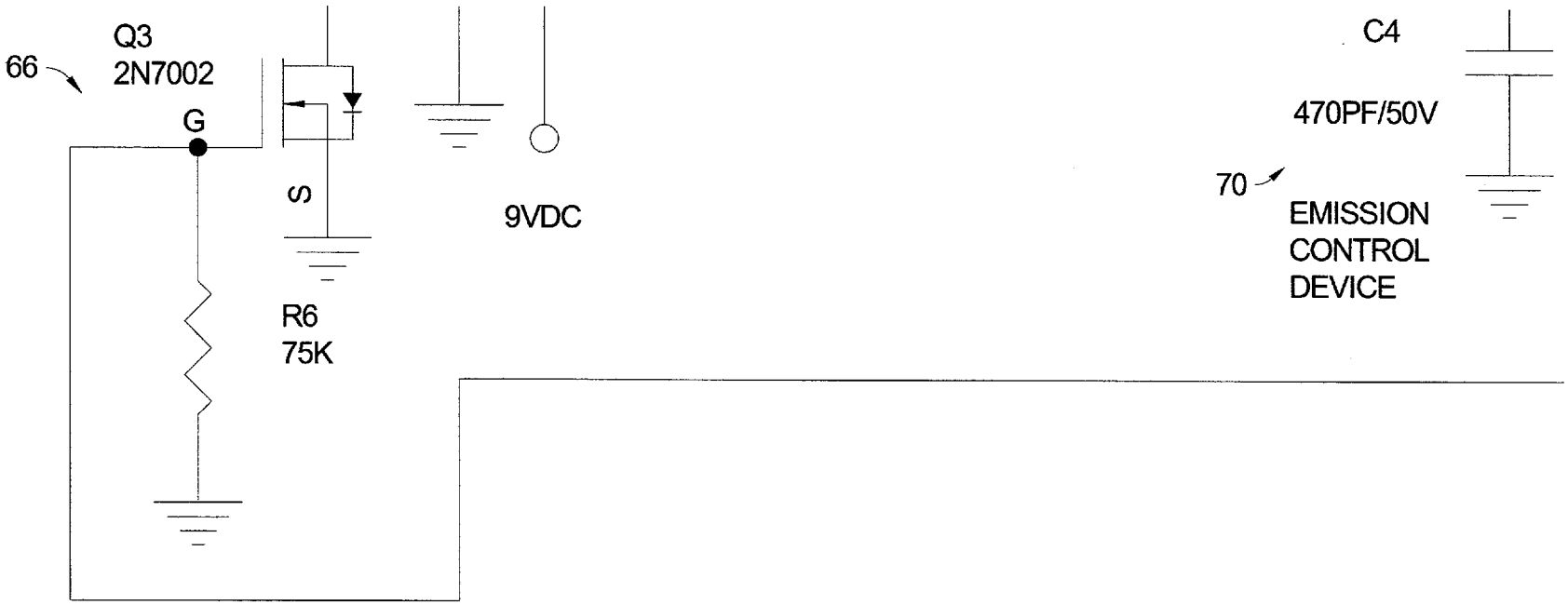
Figure 4N:
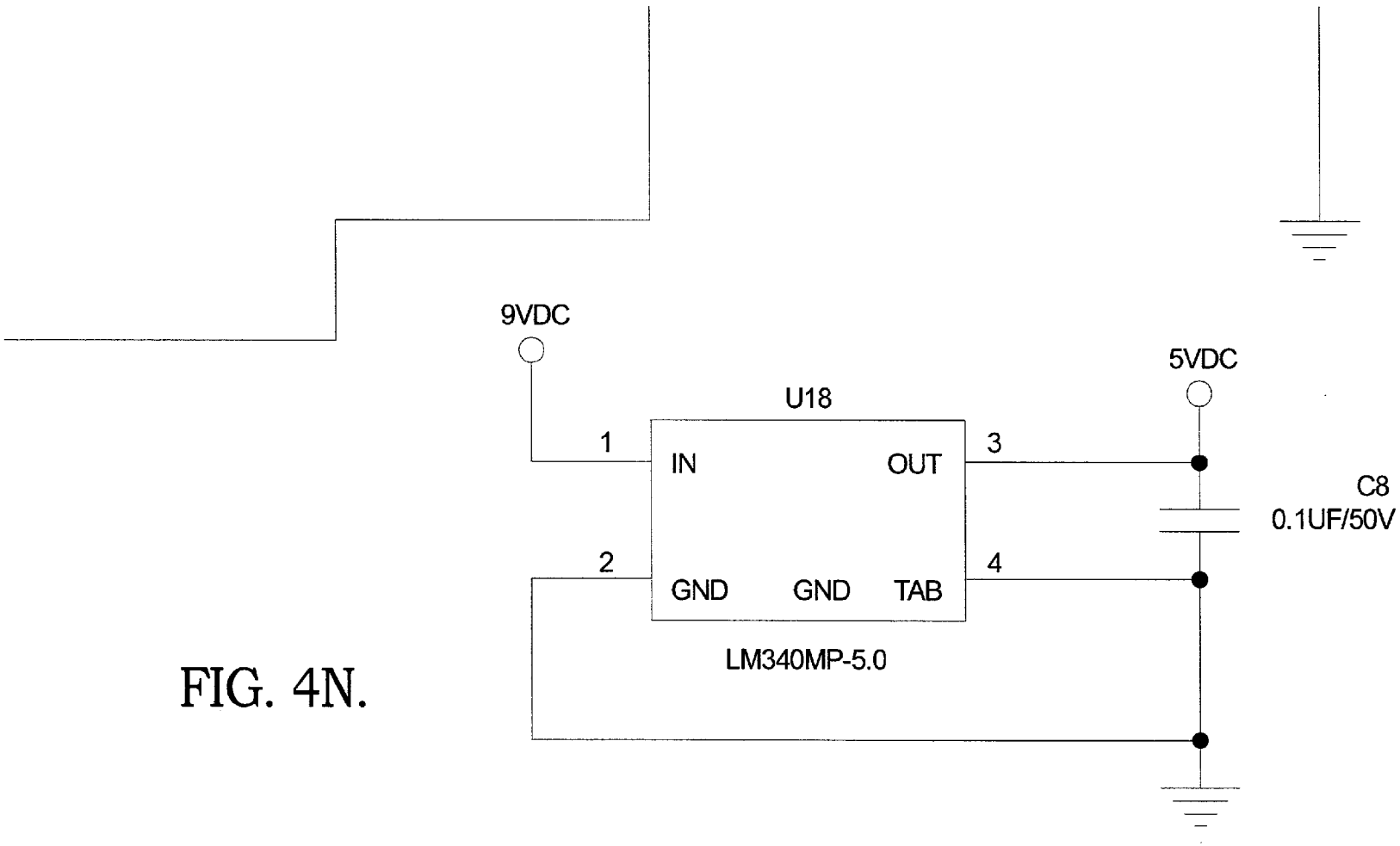
Figure 4O:
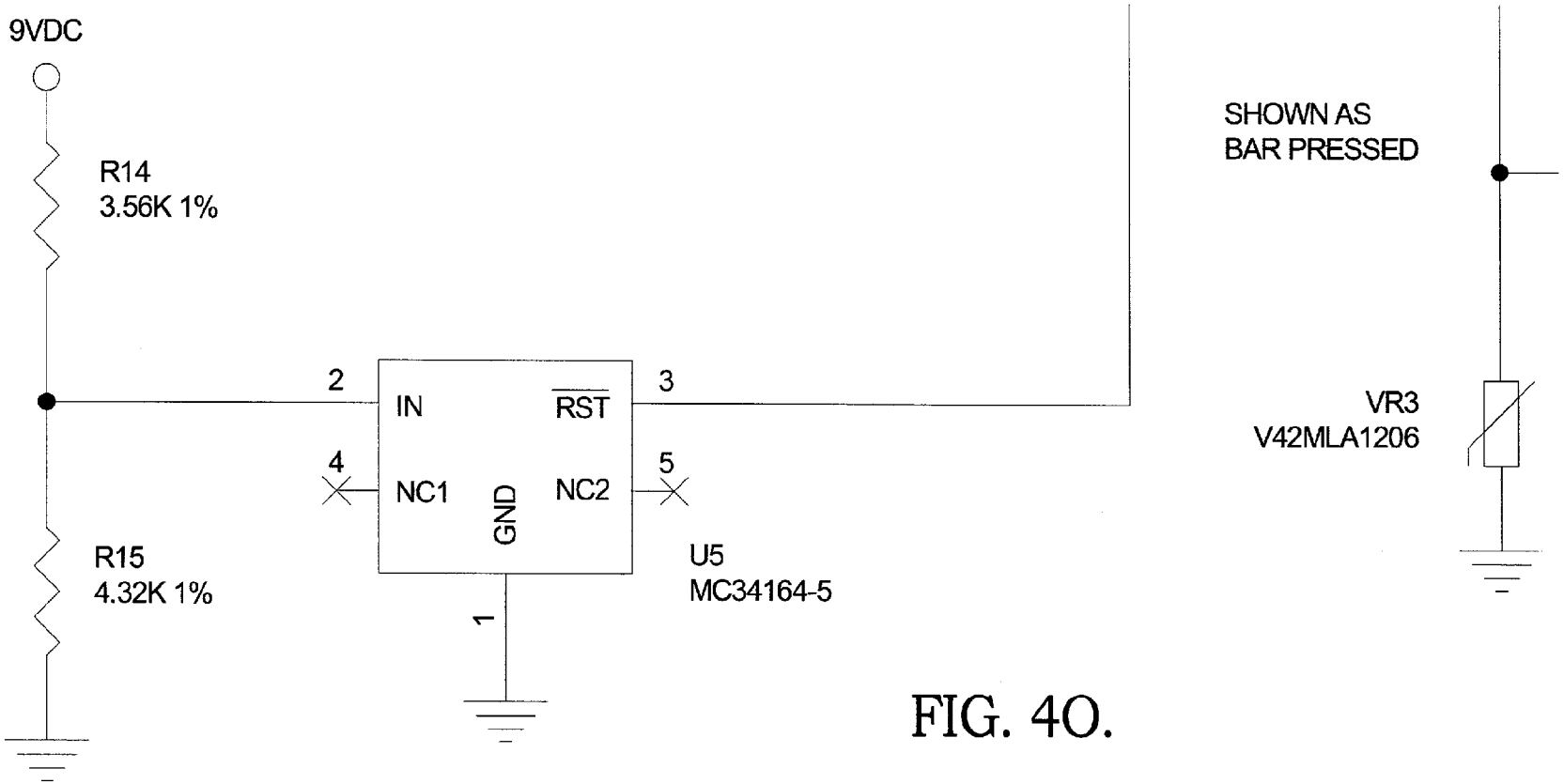
Figure 4P:
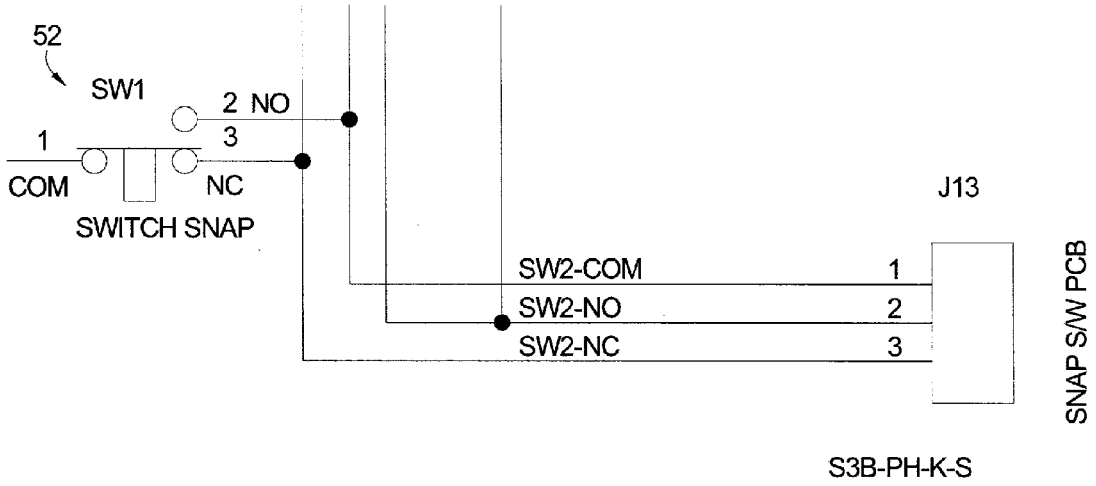

Referring now to FIGS. 4, 4A-4P and 5-7, a general control circuit for operation of system 20 is similar in overall concept to the control circuit disclosed in the incorporated U.S. Pat. No. 4,871,204, with significant improvements as noted below. FIG. 4A-4P are connecting segments of the electrical control circuit of the invention, and form the complete electrical control circuit when each segment is oriented as shown in FIG. 4.

Referring first to FIG. 4I, touch bar 44 is schematically shown as feature 62. Micro-switch 52 (FIG. 4P) by which the electromagnetic lock may be de-energized is also shown. Microprocessor 64 (FIG. 4F) generates a fixed square wave frequency of about 20 kilohertz which is voltage translated (5V to 9V) by transistor 66. This provides the clock signal to pin 11 of flip-flop device 68 (FIG. 4I), and in turn generates a 10 kilohertz square wave at 50% duty cycle from pin 13 of flip-flop device 68 (FIG. 4I). The rising edge of this signal is shaped by capacitors 70 (FIG. 4M) and 72 (FIG. 4J) and resistor 74 (FIG. 4J) before continuing to pin 5 of differential comparator 76 (FIG. 4I). Diode 78 (FIG. 4J) allows a fast discharge for the falling edge of this signal. The output at pin 13 of flip-flop device 68 (FIG. 4I) also is shaped by resistors 80 (FIG. 4I) and 82 (FIG. 4I) and capacitor 84 (FIG. 4I) and, most importantly, human capacitance, such as a hand, that would touch bar 62 (FIG. 4I). Diode 86 (FIG. 4I) allows a fast discharge for the falling edge of this signal. As potentiometer 88 (FIG. 4J) is varied, the DC reference voltage applied to pin 6 of differential comparator 76 (FIG. 4I) will vary and in turn will produce a variable phase difference between the shaped input signal applied to pin 5 of differential comparator 76 (FIG. 4I) and the square wave output signal at pin 7 of differential comparator 76 (FIG. 4I). Likewise, as the capacitance on touch bar 62 (FIG. 4I) is changed the phase difference between the shaped input signal of pin 3 on differential comparator 90 (FIG. 4E) and the square wave output signal at pin 1 of differential comparator 90 (FIG. 4E) will change. In summary, in one case first differential comparator 76 (FIG. 4I)has a fixed shaped rising input with a variable DC reference; and in the other case second differential comparator 90 (FIG. 4E) has a fixed DC reference, determined by resistors 92 (FIG. 4E) and 94 (FIG. 4E) with a variable shaped rising input (due to the changing capacitance of touch bar 62) (FIG. 4I). In both cases, there exists a potential variable phase change between the input signal and output signal of the comparators.

Referring to flip flop device 96 (FIG. 4F), the state of the flip flop included in this circuit depends on a relative timing of the clock pulse applied to its pin 3 via differential comparator 76 (FIG. 4I)and the variable input applied to its pin 5, via differential comparator 90 (FIG. 4E). Shaped square wave signals are also applied to touch bar 62 (FIG. 4I). Normally, the leading edge of the pulse applied to pin 5 of flip-flop device 96 (FIG. 4F) occurs prior to the arrival of the clock pulse at its pin 3, so the flip flop in the device remains in its same state, with its pin 1 at a high potential. However, when the capacitance of the touch bar 62 (FIG. 4I) is significantly increased, as by the touching of an object such as a hand or package, the leading edge of the pulse applied to pin 5 of flip-flop device 96 (FIG. 4F) is delayed, so that it arrives subsequent to the clock pulse applied to its pin 3. This changes the state of the flip flop so that the output at pin 1 of flip-flop device 96 (FIG. 4F) goes low, thereby turning off transistor 98 (FIG. 4F), and in turn initiates the first valid (bar touched) high pulse to the input (pin 3) of microprocessor 64 (FIG. 4F).

An important improvement of the present invention is the inclusion in the circuit after transistor 98 (FIG. 4F) of microprocessor 64 (FIG. 4F) which is programmed with intelligent electronic noise detection (discrimination) software as is known in the electronic arts. This improvement serves to filter out spurious electronic signals which are known to adversely affect prior art door release signals as are generated by circuitry in the incorporated reference.

Figure 5:
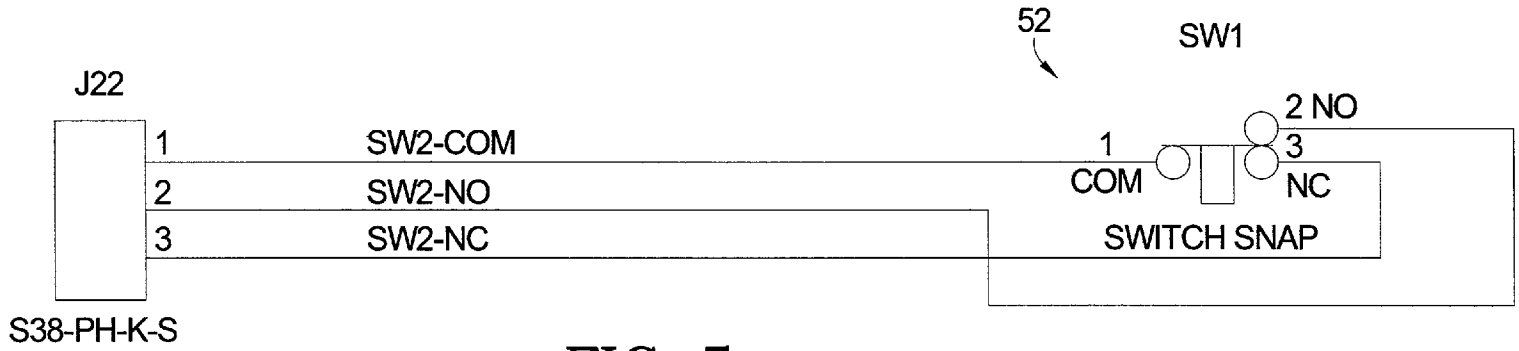
FIG. 5 is a schematic diagram of the micro-switch shown in FIG. 4 in accordance with the invention.
Figure 6:
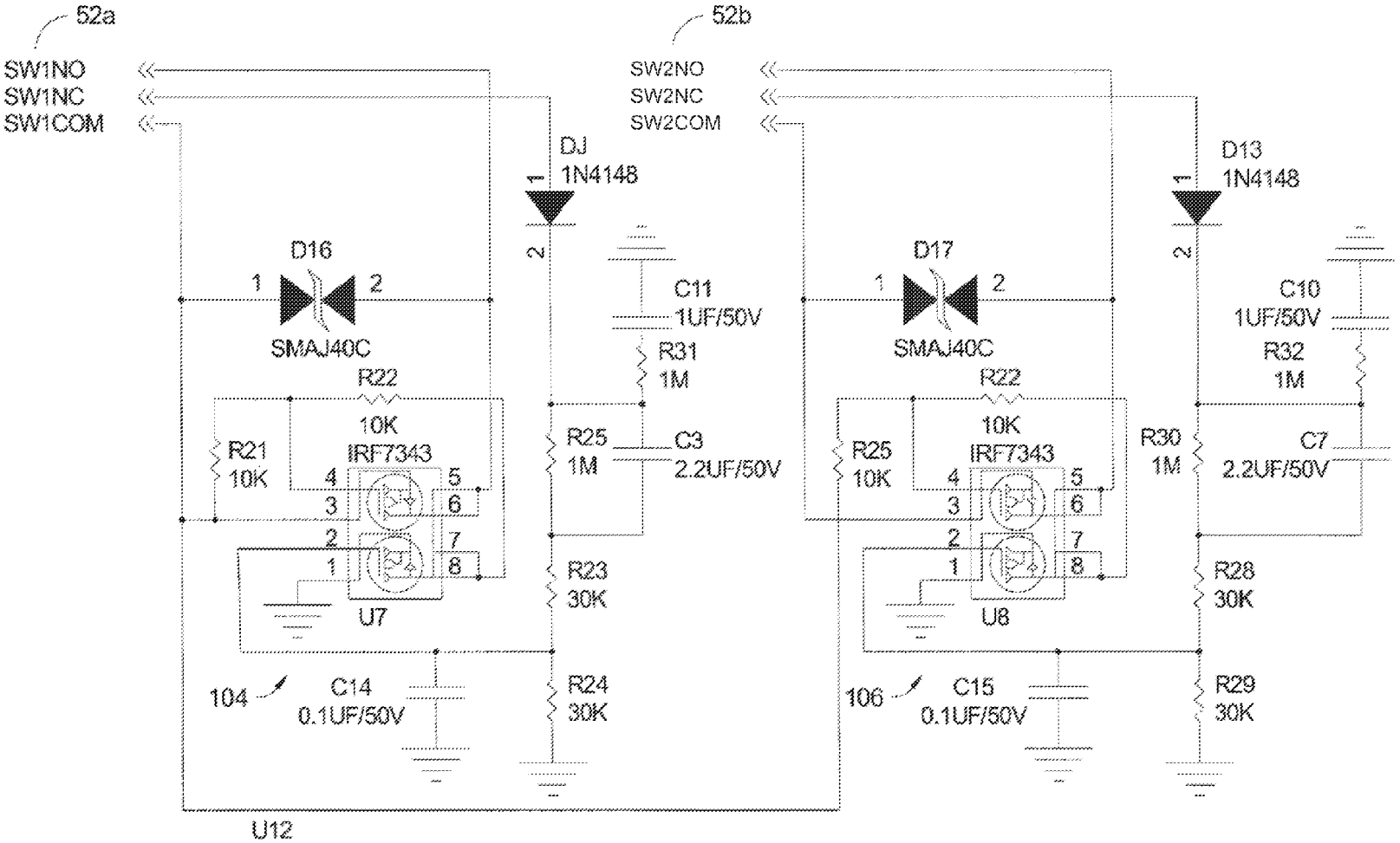
FIG. 6 is a schematic diagram of an electrical circuit, used in association with the micro-switches, in accordance with the invention for filtering out electrical noise.

Referring to FIG. 5, micro-switch 52, which is normally closed, operates to open the circuit as described above. The full circuit supporting dual micro-switches 52*a* and 52*b* is shown in FIG. 6. It has been found in the prior art that rattling a locked door may cause a spurious mechanical noise signal which can cause micro-switches 52*a* and/or 52*b* to open. This circuitry provides the filtering out of short bursts of switch activation as might be experienced when someone is pounding on the door. Switches 52*a* and52*b* are disposed near opposite ends of touch bar 44/62 and are selected and located to meet a safety requirement that less than a certain force, which may occur anywhere along the length of the touch bar 44/64, is required to deactivate the circuit and unlock the door. First and second MOS-FET switches 104, 106 function as "smart" output switches for filtering out mechanical noise to which micro-switches 52*a* and 52*b* may be susceptible. MOS-FET switches 104,106 connect to the circuit shown in FIG. 4 at junctions SW1 NO,SW1 NC,SW1 COM (108) and SW2NO,SW2NC,SW2COM (110), respectively. Each of the MOS-FET switches 104, 106 shown in FIG. 6 are referred to as a Dual N and P Channel Power MOS-FET.

Referring to the below referenced segments as shown in FIG. 4, the power supply circuit 112 (FIG. 4A) is conventional and includes an input at terminals 13, 14 which may be 12 volts to 24 volts DC. An output voltage of 9 volts is provided by power supply circuit 112 (FIG. 4A) for energization of the remainder of the data processing circuitry. Watch dog timer 114 (FIG. 4C) serves to guarantee that if microprocessor 64 (FIG. 4F) fails, the door will not open (unlock) by itself, but will then require physically pushing the bar to unlock. In that case, the capacitive operation/function of the bar is disabled.

Figure 7:
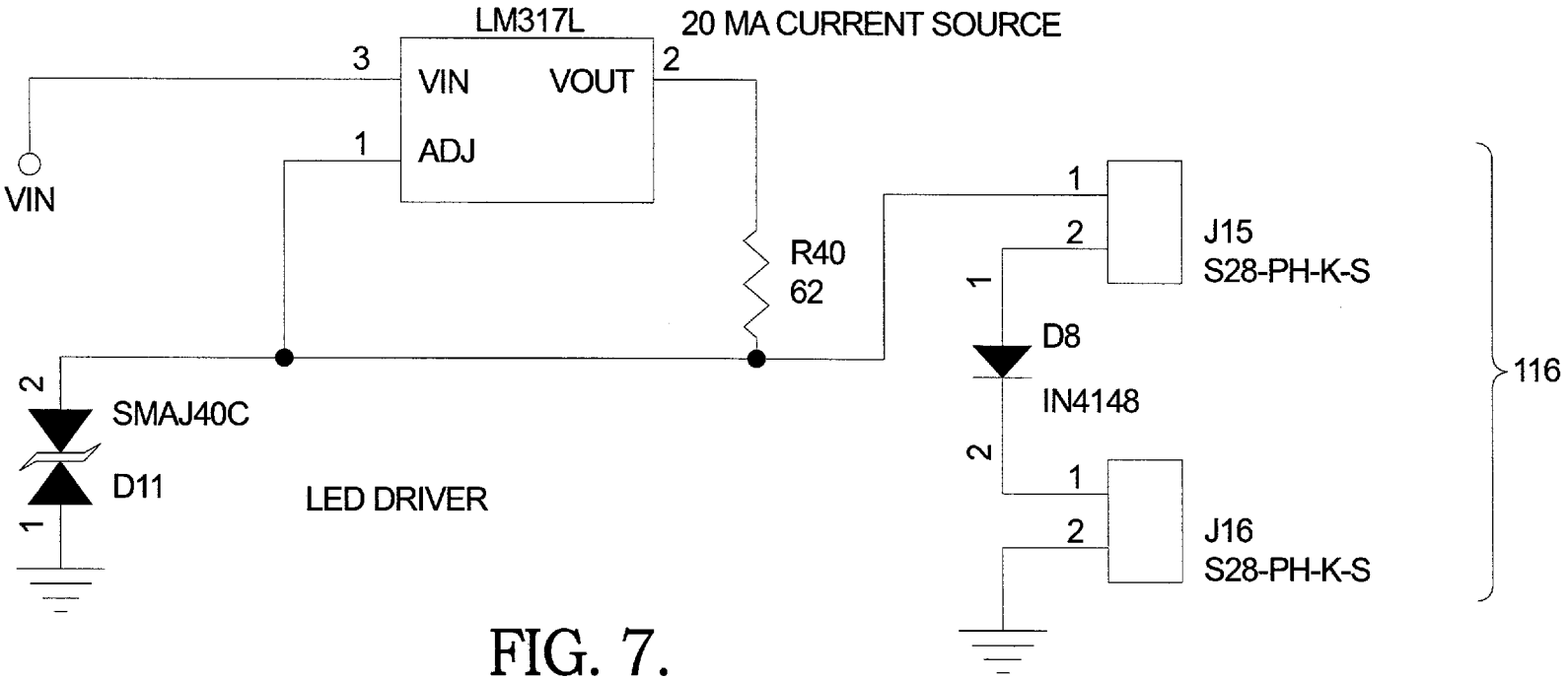
FIG. 7 is a schematic diagram of a driver circuit for illuminating the LEDs shown in FIG. 1 in accordance with the invention.

Referring to FIG. 7, a driver circuit is shown for the plurality of LEDs 116 that illuminate the door sign 60 shown in FIG. 1.

In conclusion, it is to be understood that the foregoing detailed description and the accompanying drawings are illustrative of the principles of the invention. Various alternatives and variations may be employed without departing from the principles of the invention. Thus, by way of example and not of limitation, the touch bar 44 may be circular in configuration rather than rectangular; other electrical components may be employed to implement the function of the components shown in the circuits of FIGS. 4A-4P and 5 through 7; and a different electromagnetic lock may be employed other than that shown at 16, 18. Also touch bar 44, preferably formed of aluminum, might instead be formed of a high strength plastic with an inner conductive layer extending for a substantial portion of the area of the bar facing away from the door. Also, alternatively micro-switch 52 may be mounted on the outside of actuation bar 46 with leaf spring 54 bearing directly on the surface of door 12 or against mounting bracket 32. Accordingly, the present invention is not limited precisely to the arrangements as shown and described hereinabove.

What is claimed is:

1. A system for releasing an electromagnetic lock upon detecting a proximity of a person or object, comprising:

a) a touch bar assembly including a touch bar and bracket wherein said touch bar is movably connected to said bracket;

b) at least one micro-switch configured for detecting movement between said touch bar and bracket;

c) a first capacitive circuitry connected to said touch bar and configured to detect said proximity and to release said electromagnetic lock upon such proximity detection;

d) a second circuitry integral with said first capacitive circuitry configured to release said electromagnetic lock upon a detected movement of said touch bar in relation to said bracket through a certain travel; and e) a Dual N and P Channel Power MOS-FET connected to said at least one micro-switch for filtering out mechanical noise subjected upon said at least one micro-switch.

2. The system in accordance with claim 1 further including a microprocessor configured with electronic noise detection software for filtering out spurious electronic signals in the capacitive circuit.

3. The system in accordance with claim 1 wherein said at least one micro-switch includes two micro-switches.

4. The system in accordance with claim 3 wherein said touch bar is elongate and a first of said two micro-switches is disposed on a first end of said elongate and a second of said two micro-switches is disposed on a second end of said elongate.

5. The system in accordance with claim 1 wherein said detected proximity is a touching of said touch bar by said at least a portion of said person or object.

6. The system in accordance with claim 1 wherein said detected proximity results from a movement in a first direction of said at least a portion of said person or object toward said touch bar and said movement of said touch bar in relation to said bracket results from movement of said at least a portion of said person or object in a continuation of said first direction.

7. The system in accordance with claim 1 wherein said at least a portion of said person is a hand of said person.

8. The system in accordance with claim 1 wherein said certain travel is about 0.10 inch.

9. The system in accordance with claim 1 wherein a force is required to exerted on said touch bar to move said touch bar in relation to said bracket through said certain travel and said force is about five pounds.

10. The system in accordance with claim 1 wherein said touch bar assembly comprises one or more light-emitting diodes forming a message.

11. A system in accordance with claim 1 further comprising an anti-microbial coating on said touch bar assembly.

12. A method for releasing an electromagnetic lock comprising the steps of:

a) providing a touch bar assembly including a touch bar and bracket wherein said touch bar is movably connected to said bracket;

b) providing at least one micro-switch configured for detecting movement between said touch bar and bracket;

c) providing a first circuitry configured for detecting a proximity of at least a portion of a person or object and to release said electromagnetic lock upon such proximity detection;

d) providing a second circuitry configured to release said electromagnetic lock upon said detected movement of said touch bar in relation to said bracket through a certain travel by said at least one micro-switch;

e) providing a Dual N and P Channel Power MOS-FET connected to said at least one micro-switch;

f) filtering out mechanical noise subjected upon said at least one micro-switch by said Dual N and P Channel Power MOS-FET;

g) detecting said proximity by said first circuitry;

h) energizing said first circuitry upon said detecting the proximity of said at least a portion of said person or object; and i) releasing said electromagnetic lock by said energizing of said first circuitry.

13. A method for releasing an electromagnetic lock comprising the steps of:

a) providing a touch bar assembly including a touch bar and a bracket wherein said touch bar is movably connected to said bracket;

b) providing at least one micro-switch configured for detecting movement between said touch bar and said bracket;

c) providing a first circuitry configured for detecting a proximity of at least a portion of a person or object and to release said electromagnetic lock upon such proximity detection;

d) providing a second circuitry configured to release said electromagnetic lock upon said detected movement of said touch bar in relation to said bracket through a certain travel by said at least one micro-switch;

e) providing a Dual N and P Channel Power MOS-FET connected to said at least one micro-switch;

f) filtering out mechanical noise subjected upon said at least one micro-switch by said Dual N and P Channel Power MOS-FET;

g) attempting to detect said proximity by said first circuitry;

h) detecting movement of said touch bar relative to said bracket by said at least one micro-switch; and i) releasing of said electromagnetic lock by said second circuitry upon detection of said movement of said touch bar.

14. A method in accordance with claim 13 wherein said at least a portion of said person or object is brought in said proximity of said touch bar by moving said at least a portion of said person or object in a first direction toward said touch bar, and wherein said moving of said touch bar is caused by moving said at least a portion of said person or object in a continuation of said first direction.

* * * * *